United States Patent [19]

Gromoll et al.

[11] Patent Number: 4,792,288

[45] Date of Patent: Dec. 20, 1988

[54] ENCAPSULATED COMPRESSOR

[75] Inventors: Bernd Gromoll, Baiersdorf-Hagenau; Peter Gulden, Erlangen, both of Fed. Rep. of Germany

[73] Assignee: Siemens Aktiengesellschaft, Berlin and Munich, Fed. Rep. of Germany

[21] Appl. No.: 104,172

[22] Filed: Oct. 2, 1987

[30] Foreign Application Priority Data

Nov. 28, 1986 [DE] Fed. Rep. of Germany ..... 3640650

[51] Int. Cl.[4] ..... F04B 49/00

[52] U.S. Cl. ..... 417/278; 417/302; 417/504; 417/902; 418/15

[58] Field of Search ..... 417/410, 286, 902, 288, 417/278, 279, 302, 504; 184/6.2; 418/15

[56] References Cited

U.S. PATENT DOCUMENTS

| | | | |
|---|---|---|---|
| 2,022,898 | 12/1935 | Niven | 184/6.2 |
| 2,332,007 | 10/1943 | Parker | 184/6.2 X |
| 2,760,348 | 8/1956 | McAdam | 418/15 |
| 2,988,264 | 6/1961 | Reutter | 417/902 X |
| 3,459,275 | 8/1969 | Prillwitz et al. | 418/15 |
| 3,606,604 | 9/1971 | Petersen | 418/15 X |
| 4,102,149 | 7/1978 | Conley et al. | 417/286 X |
| 4,505,122 | 3/1985 | Inomata | 417/286 X |
| 4,549,855 | 10/1985 | Ishizuka et al. | 417/286 X |
| 4,645,429 | 2/1987 | Asami et al. | 417/902 X |

FOREIGN PATENT DOCUMENTS

| | | |
|---|---|---|
| 0210349 | 4/1986 | . |
| 3424450 | 1/1986 | Fed. Rep. of Germany . |

OTHER PUBLICATIONS

Japanese Patent Abstracts vol. 9, No. 307, Dec. 4, 1985.

*Primary Examiner*—Carlton R. Croyle
*Assistant Examiner*—Theodore Olds
*Attorney, Agent, or Firm*—Kenyon & Kenyon

[57] ABSTRACT

The invention relates to a compressor (2) which is encapsulated in a housing (4) and which can be rotated about the axis (16) of its crankshaft (8) while maintaining the oil lubrication of the moving parts of the compressor. The interior (14) of the housing (4), in which an oil sump (18) is located, is connected flow-wise to the compressor (2). According to the invention, the interior (14) is connected to two gas lines (24, 26) which lead to a common manifold (32) via at least one shutoff valve (28, 30). The connecting openings (25, 27) of the two gas lines (24, 26) leading into the interior (14) are arranged opposite to one another in the vicinity of the axis (16) of the crankshaft (8). By these measures, the compressor can be inclined relative to the horizontal over a wide angular range without lubricating oil flow into the gas loop.

5 Claims, 2 Drawing Sheets

ENCAPSULATED COMPRESSOR

BACKGROUND AND SUMMARY OF THE INVENTION

The invention relates to an encapsulated, oil-lubricated compressor which is rotatable about the axis of its crankshaft.

In German Offenlegungsschrift No. 34 24 450, an encapsulated motor compressor is disclosed which can be rotated about the horizontally oriented axis of its crankshaft, maintaining the oil lubrication of the moving parts of the compressor. The suction gas enters at the end face of the compressor housing on the compressor side into the interior of the housing and flows into the compressor space of a reciprocating piston compressor via a rotably supported gas intake stub. For supplying the moving parts of the compressor with oil, a centrifugal oil disc is provided, with which a wiper is associated which is likewise supported rotably about the axis of the crankshaft. The wiper and the gas intake stub are provided with counterweights so that the wiping as well as the opening of the gas intake stub are always outside the oil sump if the motor compressor rotates about the axis of its crankshaft.

From European Offenlegungsschrift No. 0 210 349, an encapsulated rotary-piston compressor is known, in which the lubricating oil is suctioned from an oil sump by means of an oil suction stub by a dynamic underpressure generated in a pressure gas line and is transported, together with the pressurized gas compressed in the rotary piston compressor into the hollow part of the crankshaft. The crankshaft is provided within the cylinder housing of the rotary piston compressor with radial holes for supplying its moving parts with oil. The pressurized gas emerges, for instance, at the end of the crankshaft open on the motor side, into the pressure space surrounded by the compressor housing. The oil suction stub is supported rotably about the axis of the crankshaft. Thereby, the oil supply is maintained in any position resulting from any arbitrary rotation of the compressor about the horizontal axis of its crankshaft.

These known encapsulated compressors, however, can be inclined against the horizontal only within narrow limits, since on the one hand the opening of the oil scution stub or the centrifugal oil disc protrudes into the oil sump only if the oil level is sufficiently high and on the other hand, if the oil level is high, the housing opening arranged in the center of an end face of the compressor housing can be located within the oil sump also for small inclinations and thus, the lubricating oil can flow into the gas line.

It is a primary objective of the present invention to provide an encapsulated compressor, the crankshaft axis of which can be inclined against the horizontal over a wide range of angles without lubricating oil flow into the gas circulation.

According to the invention, the stated problem is solved by connecting the interior of the compressor housing to two gas lines. The two gas lines extend from a common manifold and the connecting openings of the gas lines to the housing interior are arranged opposite to one another at positions that approximately coincide with the axis of the crankshaft. Even with a small inclination of the compressor against the horizontal, already one of the two connecting openings is located within the oil sump. By means of a valve, the gas line belonging to this connecting opening can then be shut off and gas then flows in the gas line which is located between the other connecting opening and the common manifold. Since two connecting openings are provided, the oil level in the housing can be increased without the possibility that oil flows in the gas line already at small inclinations of the compressor from the horizontal.

In one advantageous embodiment, the two gas lines are each equipped with a magnetic two-way valve which are alternatingly open or closed, depending on the inclination of the compressor. In a particularly advantageous embodiment, the two gas lines are connected to the common manifold via a magnetic three-way valve.

In a particularly advantageous embodiment of a compressor, in which the compressed gas flows out into the interior of the compressor housing, at least two deflection baffles are arranged in front of at least one of the two connecting openings. The offset arrangement of passage openings in the deflection baffles causes a deflection of the gas stream and the oil taken along by the gas is separated due to inertia forces. Thereby, excessive loading with oil of the gas flowing out into the gas line is prevented.

For a further explanation of the invention, reference is made to the drawing in which:

DETAILED DESCRIPTION

Figure 1:
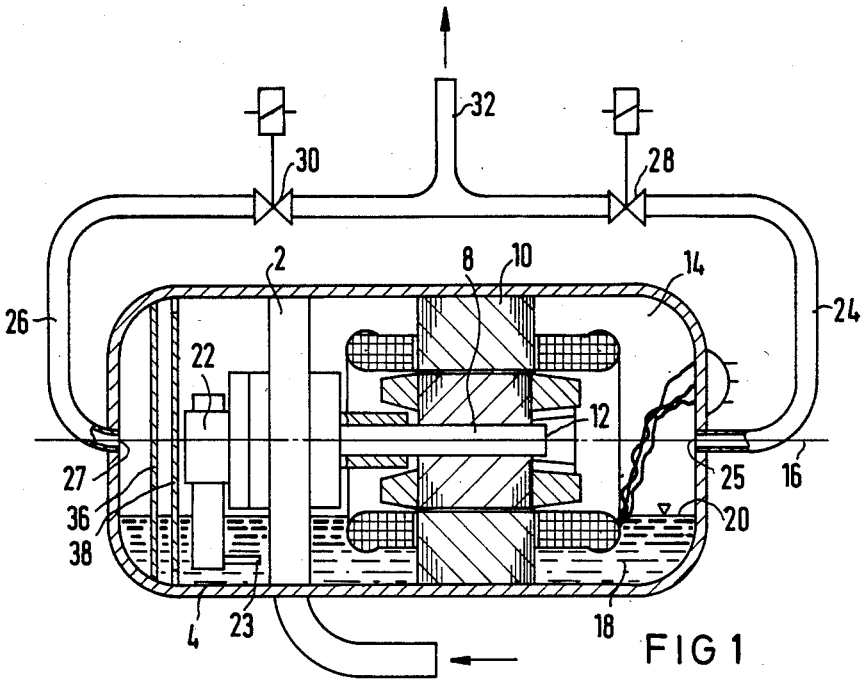
FIG. 1 is a schematic illustration of a compressor according to the invention, in cross section.

Referring now to the drawings and initially to FIG. 1, a compressor 2 is hermetically sealed in a housing 4. The compressor 2 is, for instance, a rotary piston or a reciprocating piston compressor, the piston of which is driven by a crankshaft 8 of an electric motor 10 likewise arranged in the housing 4. The compressor 2 is connected flow-wise to the interior 14 of the housing 4. The gas compressed in the compressor 2 is transported, for instance, in the at least partially hollow crankshaft 8 and emerges, after the oil is drawn in, for instance, into the at least partially hollow crankshaft 8 for instance, at end 12 on the motor side into the interior 14 enclosed by the housing 4. In the figure, the axis 16 of the crankshaft 8 extends in a horizontal plane, and within the housing 4, there is an oil sump 18, the surface of which is parallel to the axis 16. An oil suction stub 22 rotably supported about the axis 16 is immersed with its oil suction opening 24 in the oil sump 18. The oil is suctioned-on by means of a dynamic under-pressure generated in the flowing pressurized gas, is mixed with the pressurized gas and is transported to the moving parts of the compressor for lubrication. By the rotable support of the oil suction stub 22, such as is disclosed, for instance, in European Offenlegungsschrift No. 0 210 349, the lubrication is maintained also if the compressor is rotated about an axis of rotation oriented parallel to the axis 16. The interior 14 is connected to two gas lines 24 and 26 which each lead into a common manifold 32 via shutoff valves 28 and 30. The connecting openings 25 and 27 leading into the interior 14 are arranged opposite each other approximately in the center of the end faces of the housing in such a manner that their connecting line coincides at least approximately with the axis 16 of the crankshaft 8. In front of the connecting opening 27 on the compressor side, two deflecting baffles 36 and 38 are arranged for separating the oil.

Figure 2:
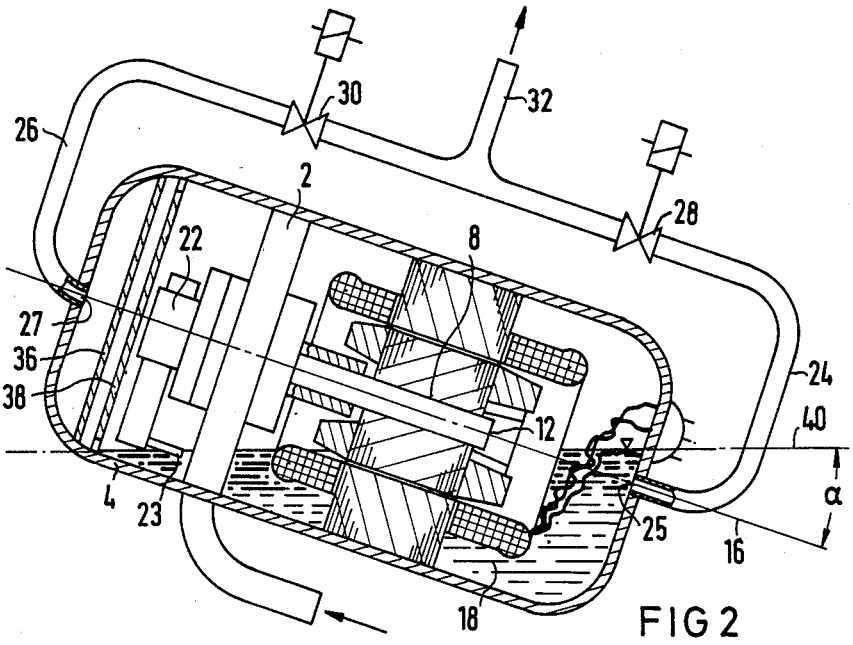
FIG. 2 illustrates a compressor which is inclined against the horizontal and in which one connecting opening is located within the oil sump.

According to FIG. 2, the compressor 2 is inclined by the angle alpha relative to the horizontal in such a manner that the connecting opening 25 on the motor side is located below the surface of the oil sump 18. The maximum possible angle of inclination, for instance, −30°, is determined by the level of the oil sump 18, the geometric dimensions of the housing 4 and the position of the oil suction opening 23 of the oil suction stub 22. The shutoff valve 28 is then closed and no oil can get into the common manifold 32 via the gas line 24. The pressurized gas leaving at the end 12 of the crankshaft 8 on the motor side then gets into the manifold 32 via the gas line 26 and the open shutoff valve 30. The pressurized gas leaving the crankshaft 8 strikes the surface of the oil sump 18 at high velocity. The oil whirled up by the pressurized gas is separated at the deflection baffles 36 and 38. An inclination in the other direction is possible up to an angle of 90° since, with a sufficiently high oil level, the oil suction opening 23 of the oil suction stub 22 is always below the surface of the oil sump 18. By these design measures, angles of inclination of +90° to about −30° can be realized; by arranging the connecting openings 25 and 27 in the center of the end faces of the housing 4, the rotatability of the motor compressor about the axis 16 of its crankshaft 8 is assured at the same time.

The same considerations also apply to a motor compressor, in which suctioned-on gas is located in the interior of the housing instead of compressed gas. The flow direction of the gas is then reversed at the connecting openings. In such an embodiment, another oil transporting device is required, for instance, with a centrifugal oil disc such as is disclosed in German Offenlegungsschrift No. 34 24 450, since an appropriate dynamic underpressure for suctioning the oil from the oil sump can no longer be generated. The maximum possible angle of inclination is determined by the position of the outer rim of the centrifugal oil disc and the oil level. The outer rim of the centrifugal oil disc must be situated here always within the oil sump, like the oil suction opening of the oil suction stub of the rotary piston compressor explained with reference to FIGS. 1 and 2.

Figure 3:
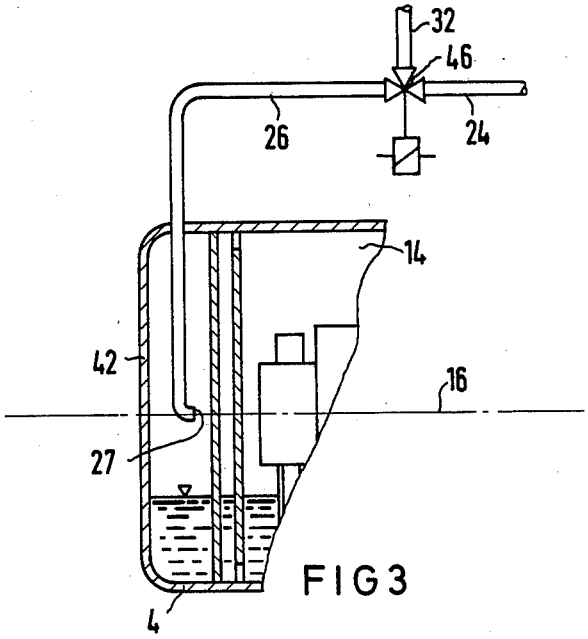
FIG. 3 illustrates an advantageous arrangement of a gas line with its connection opening in the interior of the compressor housing.

In the embodiment according to FIG. 3, the gas line 26 extends, for instance, into the interior 14 of the housing 4 and enter the interior 14 at the cylindrical part of the housing 4. The end face 42 then no longer contains interfering gas lines and the mounting of the compressor for support vibration-damped in all three spatial directions is facilitated. In the embodiment according to the figure, the gas lines 24 and 26 are connected to the common manifold 32 via a common three-way shutoff valve 46.

Figure 4:
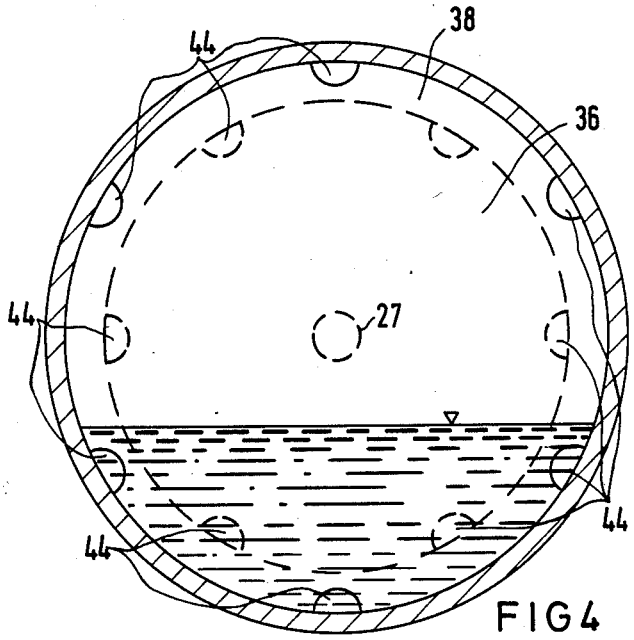
FIG. 4 illustrates a top view of a preferred design and arrangement of deflection baffles in the compressor housing in front of a connecting opening.

According to FIG. 4, the deflection baffles 36 and 38 are provided in their outer regions with approximately semicircular recesses 44. The recesses 44 are arranged offset relative to each other, so that the pressurized gas is deflected several times on its way from the end of the hollow crankshaft on the motor side to the connecting opening 27 on the compressor side. Thereby, the oil which is whirled-up and taken along by the pressurized gas especially if the compressor is inclined is separated as a consequence of inertia separation at the deflection baffles 36 and 38, and the oil content of the pressurized gas flowing from the connecting opening 27 is reduced accordingly.

In one advantageous embodiment, arranging deflection baffles also in front of the connecting opening located in the vicinity of the other end face of the housing may be of advantage if the compressed gas does not flow out axially, for instance, at the open end of a hollow crankshaft, into the interior of the housing but is ejected from the compressor, for instance, radially into the interior.

What is claimed is:

1. An encapsulated, oil-lubricated compressor including a crankshaft, said compressor being rotatable about the axis of said crankshaft, which compressor comprises:

(a) a housing having an interior to encapsulate said compressor;
(b) an oil sump located in said interior;
(c) said interior being in fluid communication with said compressor;
(d) two gas lines, each of said two gas lines including a connecting opening to said interior;
(e) said two gas lines being connected to a common manifold; and
(f) at least one shutoff valve being arranged beetween said manifold and said two gas lines;
(g) said connecting openings of said two gas lines being connected to said housing opposite to one another such that an imaginary line extending between said connecting openings coincides at least approximately with the axis of said crankshaft.

2. The compressor of claim 1, wherein: said at least one shutoff valve comprises a magnetic two-way valve between each of said two gas lines and said manifold.

3. The compressor of claim 1, wherein: said at least one shutoff valve comprises a common magnetic three-way valve.

4. The compressor according to any one of claims 1 to 3, and further (a) said compressor being operable to eject compressed gas into the interior of the housing; and
(b) deflection baffles arranged in front of at least one of said connecting openings;
(c) said deflection baffles including passage openings arranged offset relative to each other.

5. The compressor of claim 4, wherein: said passage openings comprise recesses formed in the outer regions of said deflection baffles.

* * * * *